US006749275B2

(12) United States Patent
Cutler et al.

(10) Patent No.: US 6,749,275 B2
(45) Date of Patent: Jun. 15, 2004

(54) QUICK-MOUNT SUPPORT SYSTEM FOR TELESCOPING SLIDE

(75) Inventors: Phillip B. Cutler, Westfield, IN (US); William B. Greenwald, Beech Grove, IN (US)

(73) Assignee: General Devices Co., Inc., Indianapolis, IN (US)

( * ) Notice: Subject to any disclaimer, the term of this patent is extended or adjusted under 35 U.S.C. 154(b) by 0 days.

(21) Appl. No.: 10/177,164

(22) Filed: Jun. 21, 2002

(65) Prior Publication Data

US 2003/0234602 A1 Dec. 25, 2003

(51) Int. Cl.[7] ..... A47B 88/04
(52) U.S. Cl. ..... 312/334.4; 248/243; 312/350
(58) Field of Search ..... 312/330.1–334.47, 312/350; 248/241–246; 211/190–192; 292/26, 97, 123, 197

(56) References Cited

U.S. PATENT DOCUMENTS

| | | | | |
|---|---|---|---|---|
| 516,583 A | | 3/1894 | Adkins | |
| 1,698,252 A | | 1/1929 | Ashe | |
| 2,644,588 A | * | 7/1953 | Brown | 108/102 |
| 2,749,200 A | | 6/1956 | Kuss | |
| 2,809,086 A | | 10/1957 | Fall | |
| 3,054,511 A | * | 9/1962 | Erismann | 211/208 |
| 3,133,768 A | * | 5/1964 | Klakovich | 384/17 |
| 3,601,432 A | | 8/1971 | Fenwick et al. | 403/230 |
| 4,049,230 A | | 9/1977 | Minniear | 248/539 |
| 4,106,738 A | | 8/1978 | Kostecky | 248/235 |
| 4,423,914 A | | 1/1984 | Vander Ley | |
| 4,441,722 A | | 4/1984 | Pichler | |
| 4,441,772 A | | 4/1984 | Fielding et al. | |
| 4,474,492 A | * | 10/1984 | Fleitas | 403/322 |
| 5,199,777 A | | 4/1993 | Taima et al. | |
| 5,292,198 A | | 3/1994 | Rock et al. | |
| 5,405,195 A | | 4/1995 | Hobbs | |
| 5,433,517 A | | 7/1995 | Fleisch | |
| 5,580,138 A | | 12/1996 | Grabher | |
| 5,620,244 A | | 4/1997 | Yang | |
| 5,632,542 A | | 5/1997 | Krivec | |
| 5,671,988 A | | 9/1997 | O'Neill | |
| 5,683,159 A | | 11/1997 | Johnson | |
| 5,730,514 A | | 3/1998 | Hashemi | |
| 5,823,648 A | | 10/1998 | Domenig | |
| 5,904,412 A | | 5/1999 | Lammens | |
| 6,027,194 A | | 2/2000 | Fleisch | |
| 6,209,979 B1 | | 4/2001 | Fall et al. | |

FOREIGN PATENT DOCUMENTS

| | | | | |
|---|---|---|---|---|
| CA | 817754 | * | 7/1969 | 248/243 |

* cited by examiner

*Primary Examiner*—Lanna Mai
*Assistant Examiner*—Jerry A. Anderson
(74) *Attorney, Agent, or Firm*—Barnes & Thornburg

(57) ABSTRACT

A telescoping slide support assembly includes a telescoping slide assembly, a vertical rack for use in an equipment cabinet, and a quick-mount support coupled to a stationary slide included in the telescoping slide assembly. The quick-mount support includes a movable retainer and a linkage for moving the movable retainer about a pivot axis to facilitate coupling and uncoupling of the quick-mount support and the vertical rack.

25 Claims, 8 Drawing Sheets

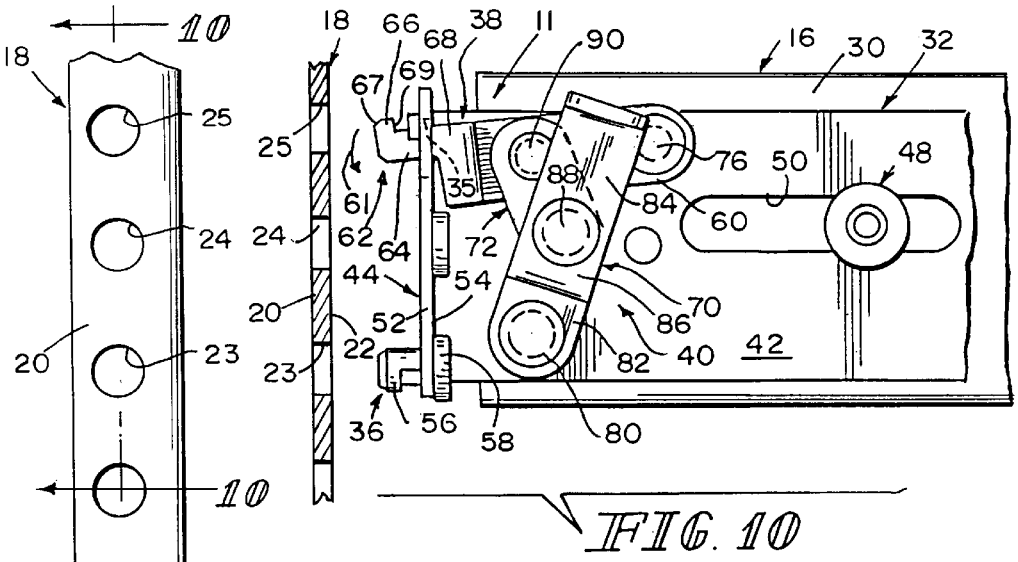
FIG. 10
FIG. 9
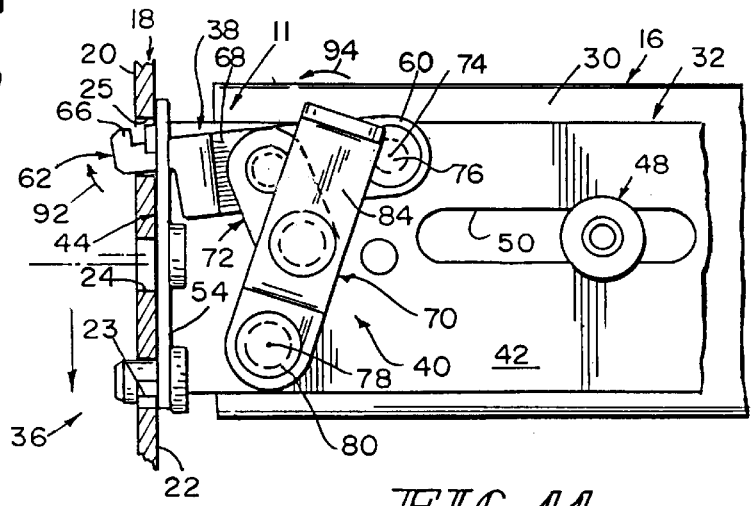
FIG. 11
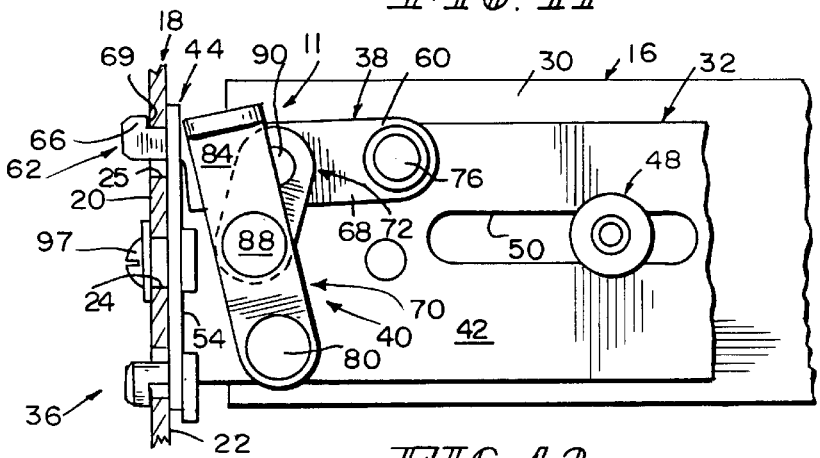
FIG. 12

QUICK-MOUNT SUPPORT SYSTEM FOR TELESCOPING SLIDE

BACKGROUND AND SUMMARY

The present disclosure relates to telescoping slide assemblies, and particularly to telescoping slide assemblies mounted on racks to support a piece of equipment for movement relative to the rack. More particularly, the present disclosure relates to bracket systems for mounting telescoping slide assemblies on racks included in an equipment cabinet.

A telescoping slide assembly support system comprises a telescoping slide assembly, a vertical rack for use in an equipment cabinet, and a quick-mount support coupled to a stationary slide included in the telescoping slide assembly. The quick-mount support is configured to be coupled quickly and easily to the vertical rack to facilitate mounting the stationary slide included in the telescoping slide assembly in a fixed position relative to the vertical rack. A load-carrying slide also included in the telescoping slide can be coupled to a piece of equipment to support that equipment for movement relative to the vertical rack first into and out of the equipment cabinet.

In an illustrative embodiment, the quick-mount support includes a fixed retainer adapted to extend into a first retainer aperture formed in the vertical rack and a movable retainer adapted to extend into a second retainer aperture formed in the vertical rack. The quick-mount support further includes a linkage configured to move the movable retainer toward and away from the fixed retainer, at the option of a user gripping and manipulating the linkage, while a retainer lug portion of that movable retainer extends through the second retainer aperture formed in the vertical rack to mate and unmate the retainer lug portion and the vertical rack. The stationary slide can be separated from the vertical rack when the retainer lug portion of the movable retainer and the vertical rack are unmated. The stationary slide cannot be separated from the vertical rack when the retainer lug portion of the movable retainer and the vertical rack are mated.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is an elevation view of the vertical rack shown in FIG. 4 showing four retainer apertures;

FIG. 10 is a sectional view taken along line 10—10 of FIG. 9 showing the quick-support mount before it is coupled to the perforated front wall of the vertical rack and showing the retainer lug in a lowered position poised to pass into one of the retainer apertures formed in the perforated front wall of the vertical rack;

FIG. 11 is a sectional view similar to FIG. 10 showing movement of the mounting bracket to engage the perforated front wall of the vertical rack and to extend the lowered retainer lug of the pivotable retainer into one of the retainer apertures formed in the front wall of the vertical rack and to extend the fixed retainer into another of the retainer apertures;

FIG. 12 is a sectional view similar to FIGS. 10 and 11 showing counterclockwise pivoting movement of the actuator to move the driver to pivot the retainer in a clockwise direction to move the retainer lug to a "raised and locked" position in the retainer aperture formed in the perforated front wall of the vertical rack;

DETAILED DESCRIPTION OF THE DRAWINGS

Figure 1:
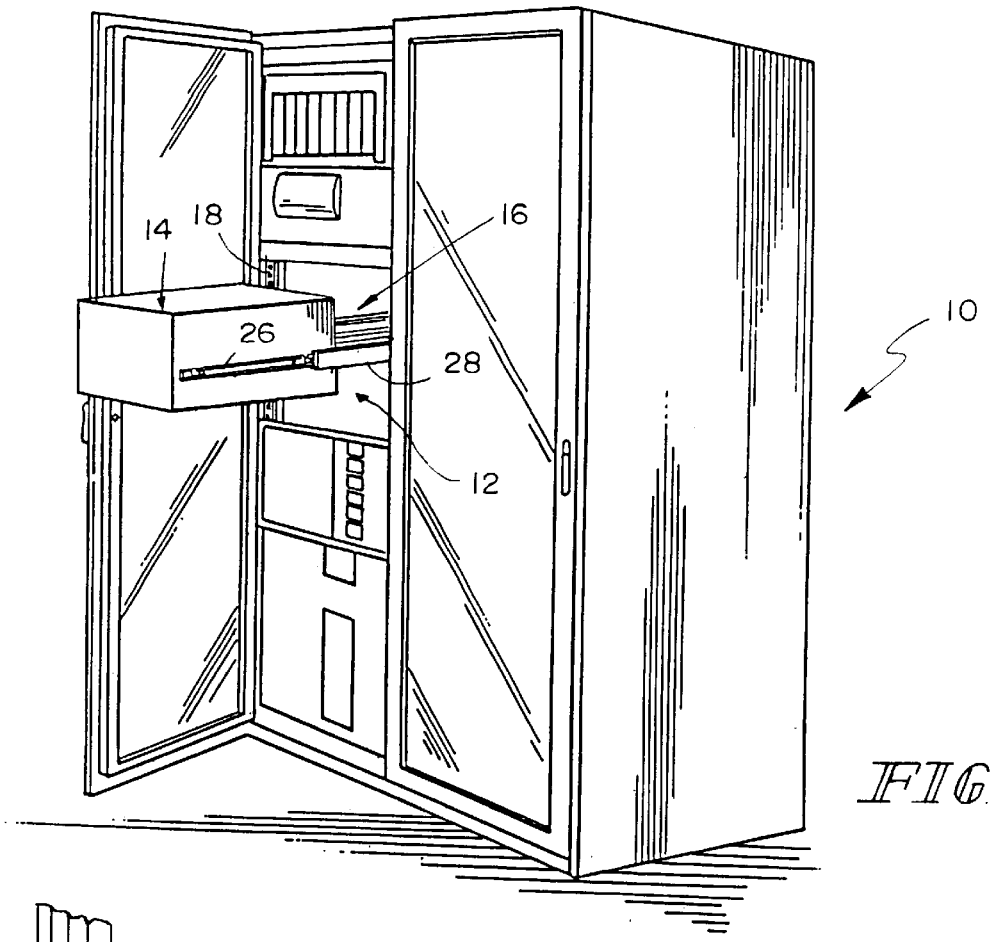
FIG. 1 is a perspective view showing a piece of equipment mounted on two fully extended telescoping slide assemblies that are mounted on vertical racks provided inside a cabinet to enable a technician to move the piece of equipment easily into and out of the cabinet.
Figure 2:
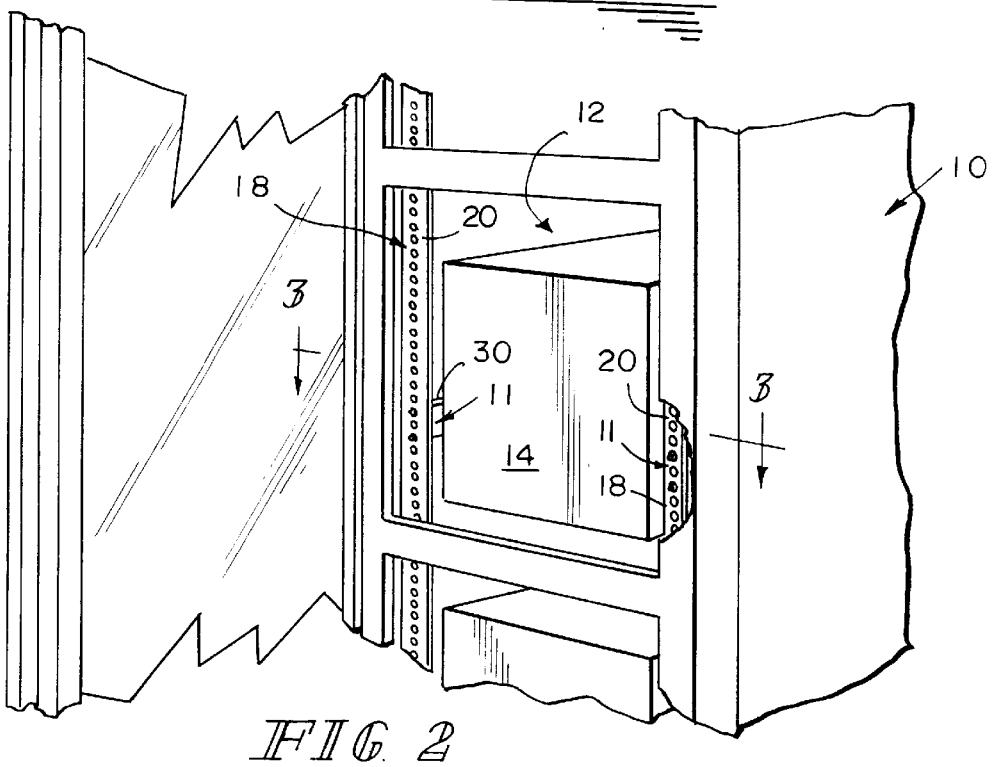
FIG. 2 is a partial perspective view of the cabinet of FIG. 1, with portions broken away, showing the piece of equipment located inside the cabinet owing to the full retraction of the telescoping slide assemblies inside the cabinet and showing two forward vertical racks and a series of retainer apertures formed in each of the forward vertical racks wherein two retainers associated with a quick-mount support coupled to a "left-side" slide assembly extend into two of the retainer apertures formed in a left-side forward vertical rack and two retainers associated with a quick-mount support coupled to a "right-side" slide assembly extend into two of the retainer apertures formed in a right-side forward vertical rack.
Figure 3:
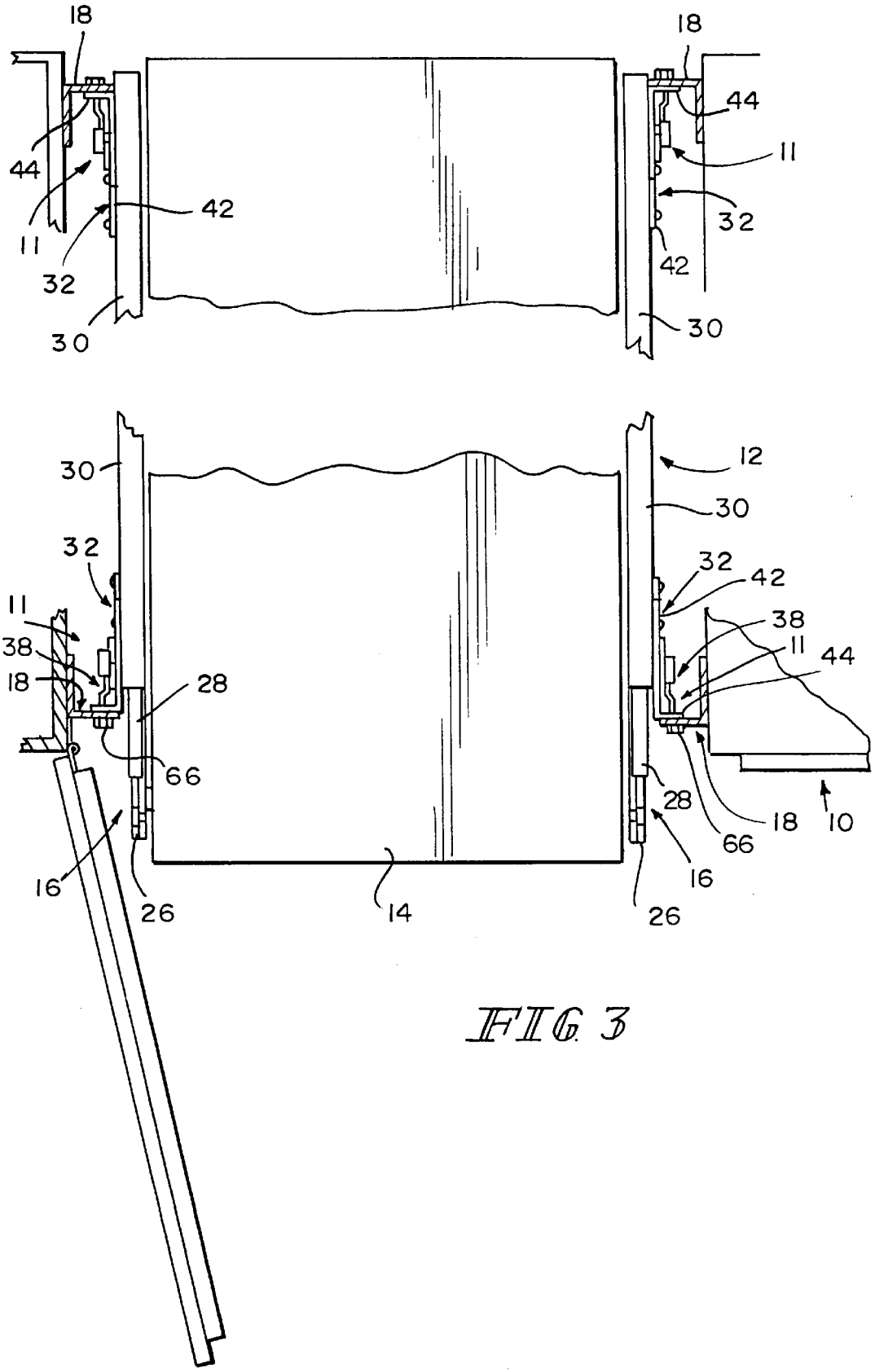
FIG. 3 is a sectional view taken along line 3—3 of FIG. 2 after the piece of equipment has been moved on the telescoping slide assemblies a short distance out of the cabinet showing a pair of spaced-apart three-part telescoping slide assemblies, a piece of equipment mounted therebetween, and four quick-mount supports and showing that each quick-mount support is coupled to one of the forward and rearward vertical racks and to a nearby portion of one of the telescoping slide assemblies to anchor the slide assemblies to the vertical racks.

An equipment cabinet 10 includes an interior region 12 adapted to store equipment therein as shown, for example, in FIGS. 1 and 2. A piece of equipment 14 is mounted on a pair of spaced-apart telescoping slide assemblies 16 for movement thereon between a fully extended position away from cabinet 10 as shown in FIG. 1 and a fully retracted position within cabinet 10 as shown in FIG. 2. Vertical racks 18 are mounted in cabinet 10 as shown, for example, in FIGS. 1–3 and telescoping slide assemblies 16 are mounted to these vertical racks 18 using the quick-mount support system disclosed herein.

Each vertical rack 18 includes a forwardly facing surface 20, a rearwardly facing surface 22, and a series of retainer apertures 23, 24, 25, etc., as shown, for example, in FIGS. 4 and 9–12. Each vertical rack 18 is coupled to equipment cabinet 10 and positioned to lie in the interior region 12 as shown, for example, in FIG. 3. It is within the scope of this disclosure to configure and orient rack 18 to support slide assemblies in a wide variety of locations within cabinet 10. In many instances, rack 18 will have a "vertical" orientation but other orientations fall within the scope of this disclosure.

Telescoping slide assembly 16 includes any suitable number of slides. In the illustrations, telescoping slide assembly 16 includes interconnected load-carrying slide 26, intermediate slide 28, and stationary slide 30. These slides 26, 28, and 30 are movable relative to one another to extend and retract load-carrying slide 26 relative to stationary slide 30 between fully extended and retracted positions as suggested in FIGS. 1 and 2. Piece of equipment 14 is coupled to spaced-apart load-carrying slides 26 in any suitable manner as shown, for example, in FIG. 3. It is within the scope of this disclosure to omit intermediate slide 28 or add additional intermediate slides (not shown).

A pair of quick-mount supports 11 is provided so that each end of each stationary slide 30 can be mounted to an adjacent vertical rack 18 quickly and easily. Thus, the telescoping slide assemblies 16 used to support equipment 14 are positioned to lie in spaced-apart parallel relation to one another in fixed positions on vertical racks 18.

Figure 18:
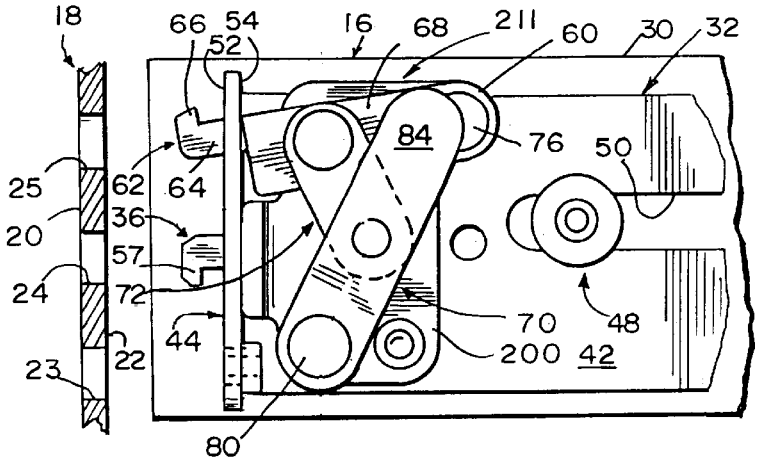
FIG. 18 is a sectional view taken along line 18—18 of FIG. 17 showing the quick-support mount before it is coupled to the perforated front wall of the vertical rack and showing the upwardly turned retainer lug in a "lowered and unlocked" position poised to pass into one of the retainer apertures formed in the front wall of the vertical rack.
Figure 19:
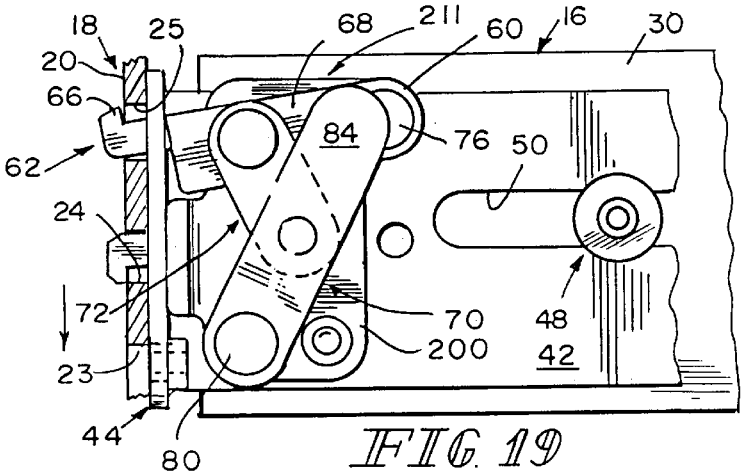
FIG. 19 is a sectional view similar to FIG. 18 showing movement of the mounting bracket to engage the perforated front wall of the vertical rack and to extend the lowered upwardly turned retainer lug of the pivotable retainer into one of the retainer apertures formed in the front wall of the vertical rack and to extend the downwardly turned retainer lug of the fixed retainer into another of the retainer apertures.
Figure 20:
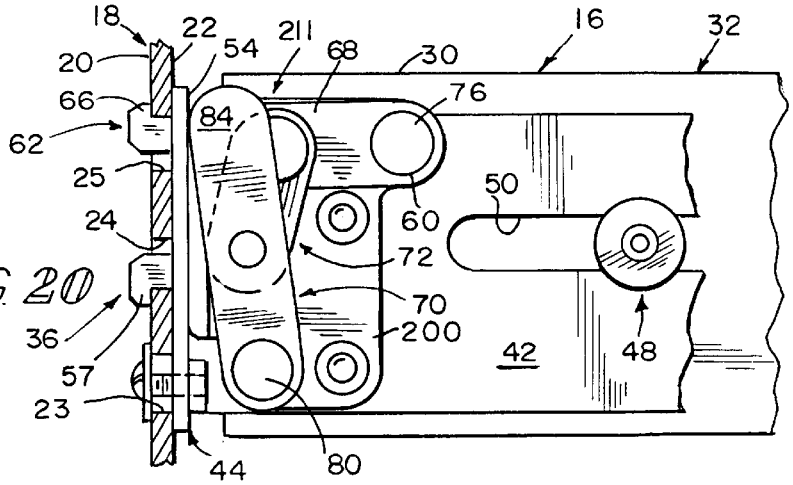
FIG. 20 is a sectional view similar to FIGS. 18 and 19 showing counterclockwise pivoting movement of the actuator to move the driver to pivot the pivotable retainer in a clockwise direction to move the upwardly turned retainer lug to a raised and locked position in the retainer aperture formed in the perforated front wall of the vertical rack.

A quick-mount support 11 in accordance with a first embodiment of this disclosure is shown in FIGS. 4–12 and a quick-mount support 211 in accordance with a second embodiment of this disclosure is shown in FIGS. 13–20. Each of quick-mount supports 11, 211 can be operated quickly and easily by a technician provided with access to interior region 12 of equipment cabinet 10 to couple quick-mount support 11 to vertical rack 18 as shown in FIGS. 10–12 and to couple quick-mount support 211 to vertical rack 18 as shown in FIGS. 18–20.

Figure 4:
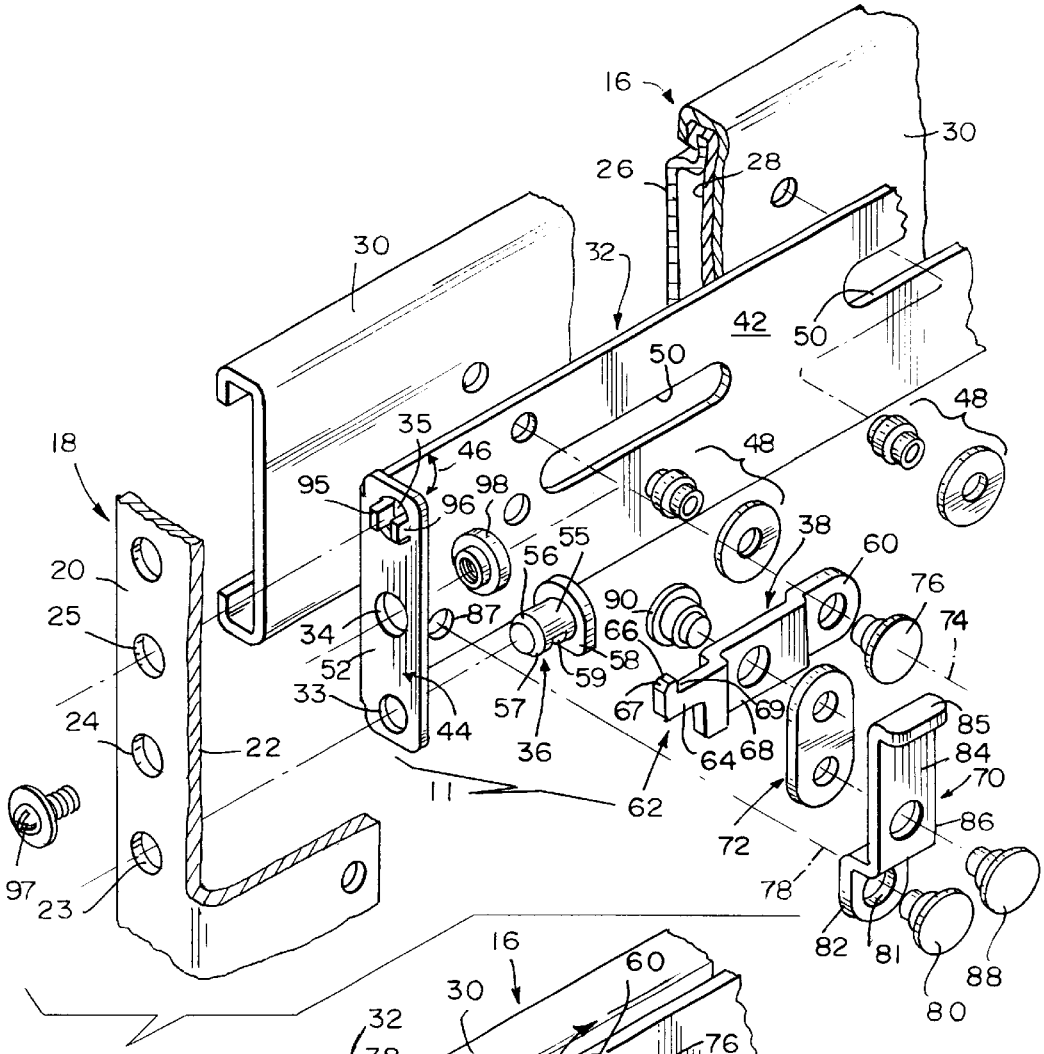
FIG. 4 is an enlarged perspective view of a portion of the right-side forward vertical rack, a portion of the three-part telescoping slide assembly associated with that vertical rack, and various components that can be assembled as shown, for example, in FIG. 5, to produce a quick-mount support in accordance with a first embodiment of this disclosure.
Figure 5:
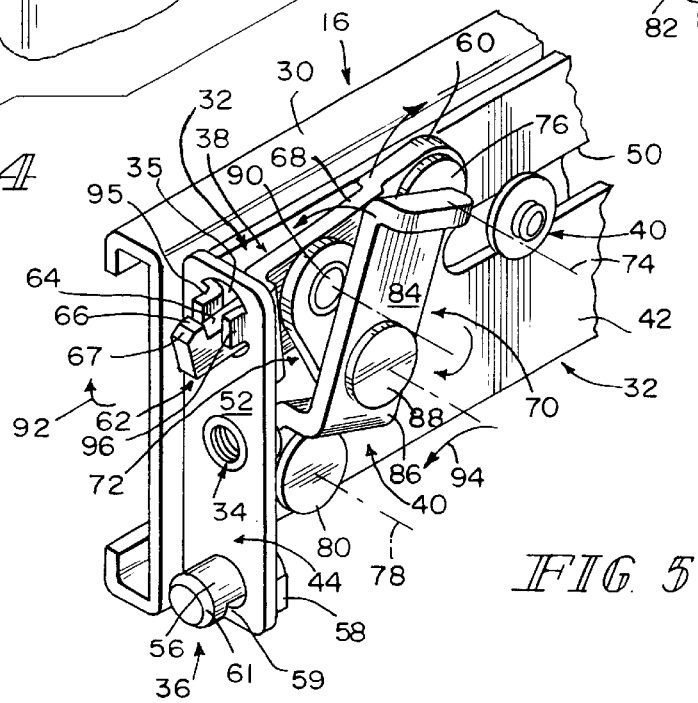
FIG. 5 is an enlarged perspective view of the quick-mount support of FIG. 4 after it has been assembled and mounted on one end of a stationary slide included in the three-part telescoping slide assembly and showing a pivotable retainer having a retainer lug extending through an aperture formed in a mounting bracket, a fixed retainer located below the pivotable retainer, a pivotable actuator provided with a finger grip, and a driver pivotably coupled to the retainer and actuator to cause the retainer to pivot about its pivot axis to move the retainer lug up or down in the mounting bracket aperture in response to pivoting movement of the actuator about its pivot axis.
Figure 7:
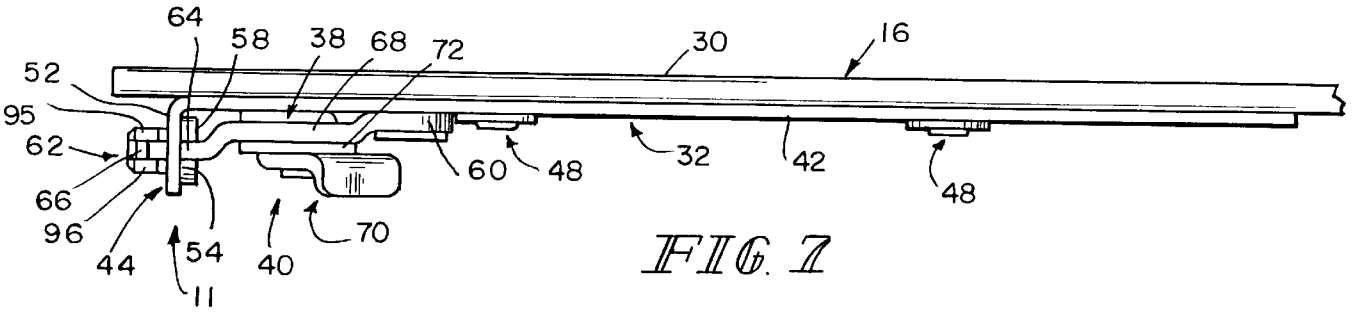
FIG. 7 is a top plan view of the quick-mount support and stationary slide of FIG. 6.

Quick-mount support 11 includes a slide support bracket 32 coupled to stationary slide 30 and formed to include a series of retainer apertures 33, 34, and 35, as shown, for example, in FIGS. 4 and 5. Quick-mount support 11 further includes a fixed retainer 36 mounted in retainer aperture 33 and adapted to extend into first retainer aperture 23 formed in vertical rack 18 when slide support bracket 32 is mated to vertical rack 18. Quick-mount support 11 also includes a movable retainer 38 and a retainer mover linkage 40 configured to move movable retainer 38 between raised and lowered positions in a retainer passageway defined by aligned retainer apertures 25, 35 (when operated by a technician) when slide support bracket 32 is mated to vertical rack 18 so that quick-mount support 11 can be coupled to and uncoupled from vertical rack 18 quickly and easily in a manner suggested in FIGS. 10–12.

Slide support bracket 32 includes a slide mount portion 42 coupled to stationary slide 30 and a rack mount portion 44 arranged to lie at an angle 46 to slide mount portion 42 as shown, for example, in FIGS. 3–6. Fasteners 48 can be arranged to extend through apertures or position-adjustment slot 50 formed in slide mount portion 42 to engage stationary slide 30 so that slide support bracket 32 is mounted in a fixed position on one end of stationary slide 30. In one embodiment, angle 46 is about 90° and slide support bracket 32 is a monolithic element wherein slide and rack mount portions 42, 44 are formed of one material (e.g., metal).

Figure 6:
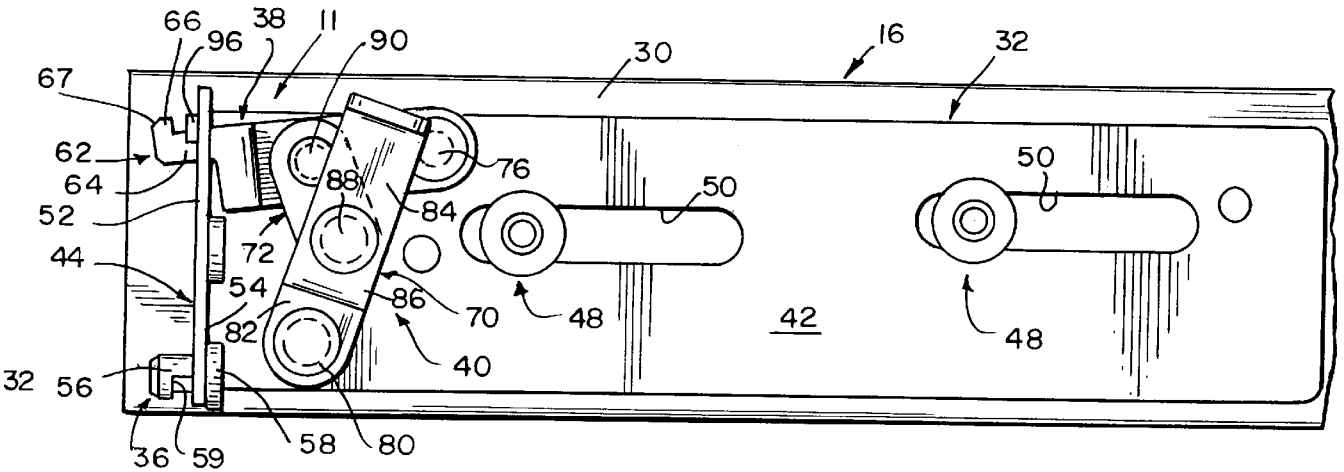
FIG. 6 is a side elevation view of the quick-mount support of FIG. 5 shown in a fixed position on the stationary slide of the telescoping slide assembly and showing the location of the fixed retainer below the pivotable retainer.
Figure 8:
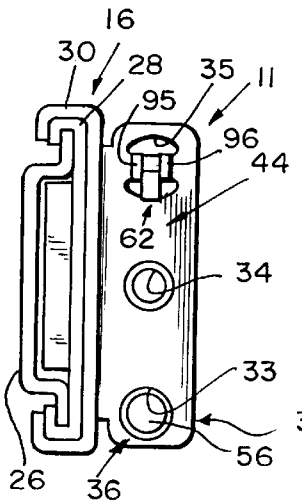
FIG. 8 is an end elevation view of the quick-mount support and telescoping slide assembly of FIGS. 6 and 7.

Rack mount portion 44 includes a forwardly facing surface 52 and a rearwardly facing surface 54 as shown, for example, in FIGS. 4–6. Forwardly facing surface 52 of rack mount portion 44 is arranged to lie in mating relation to rearwardly facing surface 22 of vertical rack 18 to align a retainer aperture 25 in vertical rack 18 with the retainer aperture 35 formed in rack mount portion 40 to form a retainer passageway 25, 35 extending from forwardly facing surface 30 of vertical rack 18 to rearwardly facing surface 54 of rack mount portion 44 as shown for example, in FIGS. 5 and 6. It is within the scope of this disclosure to place an intervening element between rack mount portion 44 and vertical rack 18 so long as a retainer passageway 25, 35 is provided to receive movable retainer 38 therein to anchor rack mount portion 44 to vertical rack 18.

As shown best in FIG. 4, fixed retainer 36 includes a post 56 appended to a base 58. In a mounted position on rack mount portion 44 of slide support bracket 32, base 58 is placed against rearwardly facing surface 54 of rack mount portion 44 and post 56 is arranged to extend through retainer aperture 33 as shown, for example, in FIG. 5. Post 56 is formed to include a body 55 and a turned-out lug 57. Post 56 also includes an inclined, frustoconical cam ramp 61. When rack mount portion 44 is mated with vertical rack 18, post 56 extends through retainer aperture 23 formed in vertical rack 18 as shown, for example, in FIGS. 11 and 12. Lug 57 includes a rearwardly facing surface 59 that is arranged to mate with forwardly facing surface 20 of vertical rack 18.

As shown best in FIG. 4, movable retainer 38 includes a base 60, a retainer lug 62 including a lug body 64 and a lug head 66, and a mid-section 68 interconnecting base 60 and lug body 64. Retainer lug body 64 is sized to move into retainer passageway 25, 35 during coupling and uncoupling of quick-mount support 11 and vertical rack 18 as suggested in FIGS. 5, 10, and 11. Retainer lug body 64 is also sized to move back and forth in that retainer passageway 25, 35 between a "lowered and unlocked position" shown, for example, in FIG. 11 and a "raised and locked position" shown, for example, in FIG. 12. In the lowered position, retainer lug 62 is arranged to pass into and out of its companion retainer passageway 25, 35 easily under the control of a technician engaged in the business of coupling or uncoupling quick-mount support 11 from a companion vertical rack 18. In the raised position, a rearwardly facing surface 69 on lug head 66 is arranged to mate with forwardly facing surface 20 of vertical rack 18 (as suggested in FIG. 12) to block movement of lug head 66 (and thus retainer lug 62 of movable retainer 38) through retainer passageway 25, 35 so as to prevent uncoupling of quick-mount support 11 and vertical rack 18.

Lug head 66 is formed to include inclined cam surface 67. Inclined cam surface 67 is arranged to engage an edge formed on vertical rack 18 to define retainer aperture 25 and to urge movable retainer 38 in a direction 61 (see FIG. 10) toward the lowered and unlocked position during movement of movable retainer 38 in retainer aperture 25.

Retainer mover linkage 40 is configured to be used by a technician to move retainer lug 62 quickly and easily to either its lowered or raised position. In the illustrated embodiment, retainer mover linkage 40 includes a pivotable actuator 70 and a driver 72 pivotably coupled to the pivotable actuator 70 and, for example, mid-section 68 of movable retainer 38 to cause movable retainer 38 to pivot about a retainer pivot axis 74 established by pivot mount 76 to move retainer lug body 64 in retainer passageway 25, 35 between the lowered and raised positions in response to pivoting movement of pivotable actuator 70 about an actuator pivot axis 78 established by pivot mount 80. In the embodiment illustrated in FIGS. 4–12, pivot mounts 76, 80 are coupled to slide mount portion 42 of slide support bracket 32. Base 60 of movable retainer 38 is arranged to intercept retainer pivot axis 74 and base 82 of pivotable actuator 70 is arranged to intercept actuator pivot axis 78 as suggested in FIG. 4.

Figure 13:
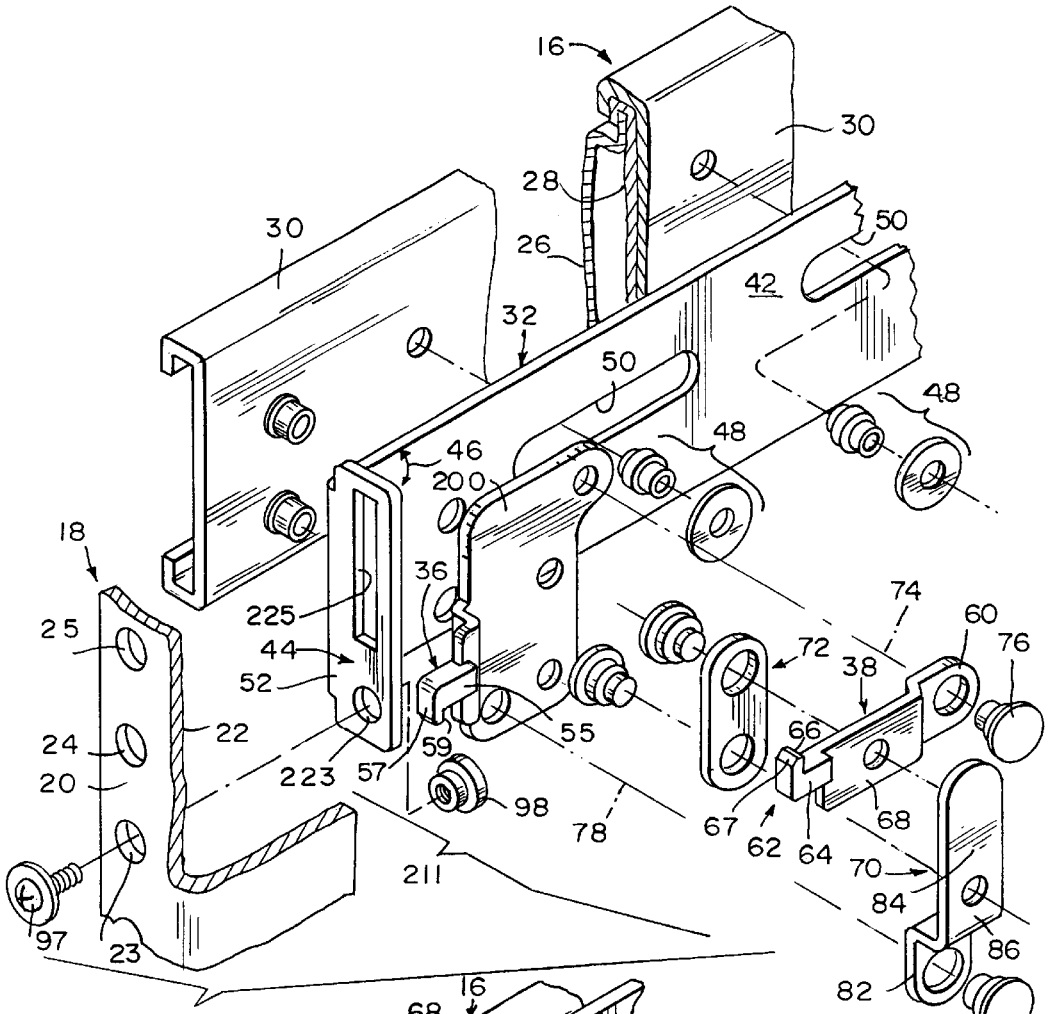
FIG. 13 is an enlarged perspective view of a portion of the right-side forward vertical rack, a portion of the three-part telescoping slide assembly associated with that vertical rack, and various components that can be assembled as shown, for example, in FIG. 14 to produce a quick-mount support in accordance with a second embodiment of this disclosure.
Figure 14:
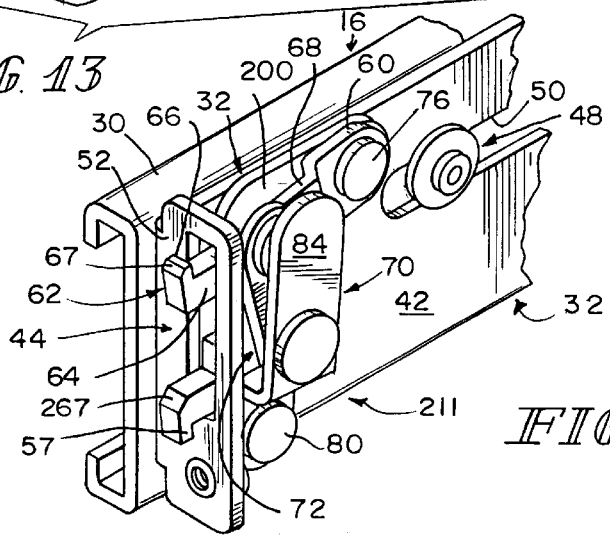
FIG. 14 is an enlarged perspective view of the quick-mount support of FIG. 13 after it has been assembled and mounted on one end of a stationary slide included in the three-part telescoping slide assembly and showing a fixed retainer having a downwardly turned retainer lug extending through a slot formed in a mounting bracket, a pivotable retainer having an upwardly turned retainer lug extending through the mounting bracket slot, a pivotable actuator provided with a finger grip, and a driver pivotably coupled to the pivotable retainer and actuator to cause the pivotable retainer to pivot about its pivot axis to move the upwardly turned retainer lug up or down in the mounting bracket slot in response to pivoting movement of the actuator about its pivot axis.
Figure 15:
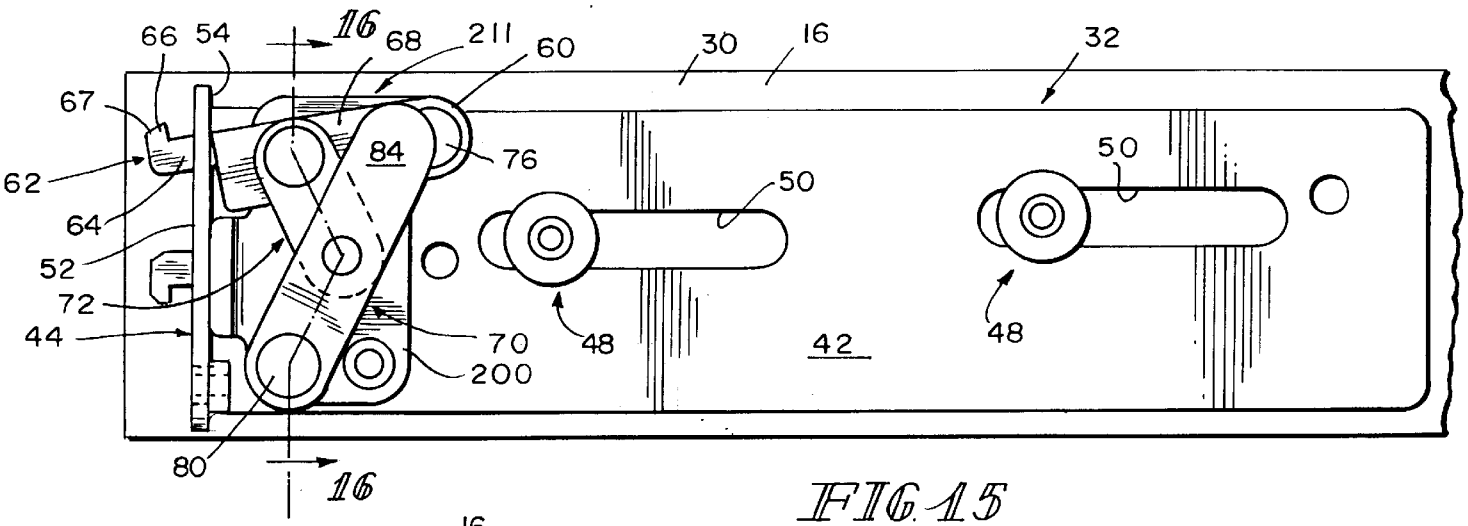
FIG. 15 is a side elevation view of the quick-mount support of FIG. 14 shown in a fixed position on the stationary slide of the telescoping slide assembly.
Figure 16:
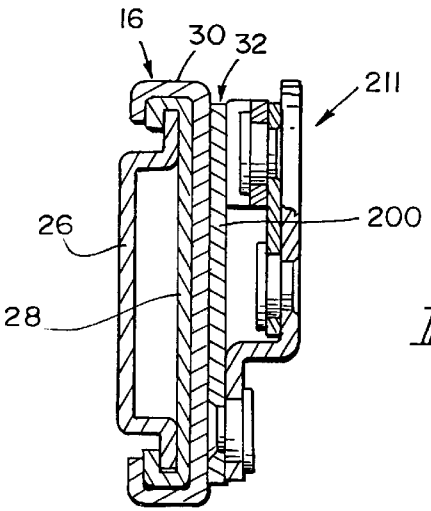
FIG. 16 is a sectional view of the quick-mount support and telescoping slide assembly taken along line 16—16 of FIG. 15.
Figure 17:
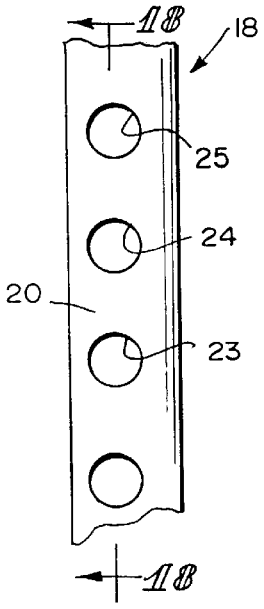
FIG. 17 is an elevation view of the vertical rack shown in FIG. 13 showing four retainer apertures.

Pivotable actuator 70 includes a base 82 formed to include an aperture 81 receiving pivot mount 80 therein, a hand-grip portion 84 (which can be formed with an out-turned lip 85 as shown in FIG. 4 or formed without such a lip as shown in FIG. 13), and a mid-section 86 interconnecting base 82 and hand-grip portion 84. Pivot mount 80 extends into an aperture 87 formed in slide mount portion 42 as suggested in FIG. 4.

One end of driver 72 is mounted on a pivot mount 88 arranged to extend through apertures formed in each of driver 72 and mid-section 86 of pivotable actuator 70. Another end of driver 72 is mounted on a pivot mount 90 arranged to extend through apertures formed in each of driver 72 and mid-section 68 of movable retainer 38. Driver 72 is positioned to lie in a space between movable retainer 38 and pivotable actuator 70 as shown, for example, in FIG. 5.

As shown in the sequence illustrated in FIGS. 10–12, fixed retainer 36 is arranged to extend through a first retainer aperture 23 formed in vertical rack 18 and movable retainer 38, while retainer lug 62 occupies its lowered position, is arranged to extend through a second retainer aperture 25 formed in vertical rack 18 as the quick-mount support 11 on stationary slide 30 is coupled to vertical rack 18. Once retainers 36, 38 extend through retainer apertures 23, 25 as shown, for example, in FIG. 11, a technician uses retainer mover linkage 40 to pivot movable retainer 38 about retainer pivot axis 74 in direction 92 through an acute angle from the lowered position shown in FIG. 11 to the raised position shown in FIG. 12. To this end, the technician pivots pivotable actuator 70 about actuator pivot axis 78 in direction 94 to move driver 72 to cause movable retainer 38 to move as described and shown.

As shown best in FIGS. 4 and 5, slide support bracket 32 further includes a pair of locator arms 95, 96 arranged to lie in spaced-apart parallel relation to one another to receive the movable retainer 38 (e.g., lug body 64) therebetween. Each of locator arms 95, 96 is coupled to rack mount portion 44 and arranged to extend away from forwardly facing surface 52 of rack mount portion 44 into the second retainer aperture 25 formed in vertical rack 18 and to lie in side-by-side relation to retainer lug body 64 of movable retainer 38.

Quick-mount support 11 further includes a connector 97 arranged to pass through aligned connector retainer apertures 24, 34 formed, respectively, in each of vertical rack 18 and rack mount portion 44. Connector 97 and fastener 98 are configured to secure rack mount portion 44 in a fixed position relative to vertical rack 18 as shown, for example, in FIG. 12.

In the embodiment of FIGS. 13–20, rack mount portion 44 is formed to include a vertical slot 225 sized to receive fixed retainer 36 and movable retainer 38 therein. Connector 97 extends through retainer aperture 223 formed in rack mount portion 44 below slot 225 to engage fastener 98. In this embodiment, quick-mount support 211 includes a base plate 200 coupled to slide mount portion 42 of slide support bracket 32 in FIGS. 13–16. Base plate 200 is positioned to lie between slide mount portion 42 and movable retainer 38 and movable retainer 38 is positioned to lie between base plate 200 and driver 72. Fixed retainer 36 in the embodiment of FIGS. 13–20 includes inclined cam surface 267.

Fixed retainer 36 is coupled to base plate 200 as shown, for example, in FIG. 13, and arranged to extend through retainer aperture (vertical slot) 225 formed in rack mount portion 44. Movable retainer 38 also passes through retainer aperture 225. Pivot mount 76 is coupled to base plate 200 to establish retainer pivot axis 74 for movable retainer 38 and pivot mount 80 is also coupled to base plate 200 to establish actuator pivot axis 78 for pivotable axis 78.

What is claimed is:

1. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures, a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, and a first locator arm arranged to extend through the second of the retainer apertures and to lie in side-by-side relation to the movable retainer.

2. The system of claim 1, wherein the quick-mount support further includes a second locator arm arranged to lie in spaced-apart relation to the first locator arm to receive the movable retainer therebetween.

3. The system of claim 2, wherein the quick-mount support further includes a rack mount portion coupled to the first and second locator arms and a forwardly facing surface of the rack mount portion is arranged to lie in mating relation to a rearwardly facing surface of the vertical rack to place a retainer apertige formed in the rack mount portion in alignment with the second of the retainer apertures formed in the vertical rack to form a retainer passageway containing a portion of the movable retainer as the movable retainer moves between the raised and locked position and the lowered and unlocked position.

4. The system of claim 3, wherein the quick-mount support further includes a slide mount portion arranged to lie at an angle to the rack mount portion and the movable retainer is mounted for pivotable movement to the slide mount portion.

5. The system of claim 1, wherein the movable retainer includes a lug with a body arranged to extend through the second of the retainer apertures when the movable retainer is located in the lowered and unlocked position and the retainer lug further includes a head having rearwardly facing surface arranged to mate with a forwardly facing surface of the vertical rack upon movement of the movable retainer in the retainer passageway to the raised and locked position to block movement of the head of the retainer lug through the second of the retainer apertures formed in the vertical rack.

6. The system of claim 5, wherein the head of the retainer lug is formed to include an inclined cam surface arranged to engage an edge formed on the vertical rack to define the second of the retainer apertures and to urge the movable retainer in a direction toward the lowered and unlocked position during movement of the movable retainer into the second of the retainer apertures.

7. The system of claim 1, wherein the quick-mount support further includes a connector arranged to pass through aligned connector apertures formed in each of the vertical rack and the rack mount portion and configured to secure the rack mount portion in a fixed position relative to the vertical rack.

8. The system of claim 7, wherein the connector is positioned to lie in a location between the retainer passageway and the fixed retainer.

9. The system of claim 1, wherein the quick-mount support further includes a slide support bracket including a slide mount portion coupled to the stationary slide and a rack mount portion arranged to lie at an angle to the slide mount portion, a forwardly facing surface of the rack mount portion is arranged to lie in mating relation to a rearwardly facing surface of the vertical rack to place a retainer aperture formed in the rack mount portion in alignment with the second of the retainer apertures formed in the vertical rack to form a retainer passageway containing a portion of the movable retainer as the movable retainer moves between the raised and locked position and the lowered and unlocked position.

10. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures and a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, wherein the movable retainer includes a retainer lug configured to extend through the second of the retainer apertures when the movable retainer is located in the lowered and unlocked position and to mate with a forwardly facing surface on the vertical rack when the movable retainer is located in the raised and locked position and the quick-mount support further includes mover means engaging with and moving the movable retainer to the lowered and unlocked position to permit movement of the retainer lug into and out of the second of the retainer apertures during coupling and uncoupling of the quick-mount support and the vertical rack and to the raised and locked position to mate the retainer lug and the vertical rack to block uncoupling of the quick-mount support and the vertical rack.

11. The system of claim 10, wherein the retainer lug is formed to include an inclined cam surface arranged to engage an edge formed on the vertical rack to define the second of the retainer apertures and to urge the movable retainer in a direction toward the lowered and unlocked position during movement of the movable retainer into the second of the retainer apertures.

12. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures and a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, wherein the movable retainer includes a retainer lug configured to extend through the second of the retainer apertures when the movable retainer is located in the lowered and unlocked position and to mate with a forwardly facing surface on the vertical rack when the movable retainer is located in the raised and locked position and the quick-mount support further includes mover means for moving the movable retainer to the lowered and unlocked position to permit movement of the retainer lug into and out of the second of the retainer apertures during coupling and uncoupling of the quick-mount support and the vertical rack and to the raised and locked position to mate the retainer lug and the vertical rack to block uncoupling of the quick-mount support and the vertical rack, the mover means including a pivotable actuator provided with a finger grip and a driver pivotably coupled to the pivotable actuator and movable retainer to cause the movable retainer to pivot about the retainer pivot axis to move a portion of the retainer lug in the second of the retainer apertures in response to pivoting movement of the pivotable actuator about an actuator pivot axis.

13. The system of claim 12, wherein the driver is positioned to lie between the movable retainer and a portion of the pivotable actuator.

14. The system of claim 12, wherein the movable retainer further includes a base arranged to intercept the retainer pivot axis and a mid-section interconnecting the retainer lug and the base and the driver is pivotably coupled to the mid-section of the movable retainer.

15. The system of claim 12, wherein the quick-mount support further includes a slide support bracket including a slide mount portion coupled to the stationary slide and a rack mount portion formed to include a retainer aperture and arranged to lie at an angle to the slide mount portion and to lie in mating relation to the vertical rack to align the retainer aperture formed in the rack mount portion with the second of the retainer apertures formed in the vertical rack to define a retainer passageway receiving the retainer lug therein, the fixed retainer is coupled to the rack mount portion, the pivotable actuator is coupled to the slide mount portion to pivot about the actuator pivot, and the movable retainer is positioned to lie between the driver and the slide mount portion.

16. The system of claim 12, wherein the quick-mount support further includes a slide support bracket including a slide mount portion coupled to the stationary slide and a rack mount portion formed to include first and second retainer apertures and arranged to lie at an angle to the slide mount portion and to lie in mating relation to the vertical rack to align the second retainer aperture formed in the rack mount portion with the second of the retainer apertures formed in the vertical rack to define a retainer passageway receiving the retainer lug therein, the quick-mount support further includes a base plate coupled to the slide support bracket, the fixed retainer is coupled to the base plate and arranged to extend through the first retainer aperture formed in the rack mount portion to reach the first of the retainer apertures formed in the vertical rack, the base plate is positioned to lie between the slide mount portion and the movable retainer, and the movable retainer is positioned to lie between the base plate and the driver.

17. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a set of retainer apertures, and a quick-mount support coupled to the stationary slide, the quick-mount support including a movable retainer mounted for pivotable movement relative to the stationary slide about a retainer pivot axis through an acute angle between a mated position and an unmated position, the movable retainer including a base arranged to intercept the retainer pivot axis, a retainer lug having a body arranged to extend through one of the retainer apertures and a head coupled to the body and arranged to mate with a forwardly facing surface of the vertical rack upon movement of the movable retainer to the mated position and to unmate from the forwardly facing surface of the vertical rack upon movement of the movable retainer to the unmated position, the quick-mount support further including mover means engaging with and moving the movable retainer to the unmated position to permit movement of the head of the retainer lug into and out of said one of the retainer apertures formed in the vertical rack during coupling and uncoupling of the quick-mount support and the vertical rack and to the mated position to mate the head of the retainer lug and the forwardly facing surface of the vertical rack to block uncoupling of the quick-mount support and the vertical rack.

18. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a set of retainer apertures, and a quick-mount support coupled to the stationary slide, the quick-mount support including a movable retainer mounted for pivotable movement relative to the stationary slide about a retainer pivot axis through an acute angle between a mated position and an unmated position, the movable retainer including a base arranged to intercept the retainer pivot axis, a retainer lug having a body arranged to extend through one of the retainer apertures and a head coupled to the body and arranged to mate with a forwardly facing surface of the vertical rack upon movement of the movable retainer to the mated position and to unmate from the forwardly facing surface of the vertical rack upon movement of the movable retainer to the mated position, and a mid-section interconnecting the base and the body of the retainer lug, the quick-mount support further including a pivotable actuator provided with a finger grip and mounted for pivotable movement relative to the stationary slide about an actuator pivot axis and a driver pivotably coupled to the pivotable actuator and to the mid-section of the movable retainer to cause the movable retainer to move in one direction about the retainer pivot axis in response to movement of the pivotable actuator in another direction about the actuator pivot axis to move the movable retainer relative to the stationary slide and the vertical rack between the mated and unmated positions.

19. The system of claim 18, wherein the quick-mount support further includes a slide support bracket coupled to the stationary slide and arranged to lie in mating relation to the vertical rack to position a retainer aperture formed in the slide support bracket in alignment with said one of the retainer apertures formed in the vertical rack to define a retainer passageway receiving the body of the retainer lug therein and each of the movable retainer and the pivotable actuator is pivotably mounted on the slide support bracket.

20. The system of claim 19, wherein the slide support bracket includes a slide mount portion slidably coupled to the stationary slide and pivotably coupled to each of the movable retainer and the pivotable actuator and a rack mount portion formed to include the retainer aperture and the quick-mount support further includes a fixed retainer coupled to the rack mount portion and arranged to extend through another of the retainer apertures formed in the vertical rack.

21. The system of claim 19, wherein a forwardly facing surface of the slide support bracket is arranged to lie in mating relation to a rearwardly facing surface of the vertical rack to place the retainer aperture formed in the slide support bracket in alignment with said one of the retainer apertures formed in the vertical rack and the quick-mount support further includes a locator arm coupled to the slide support bracket and arranged to extend away from the forwardly facing surface of the slide support bracket into said one of the retainer apertures formed in the vertical rack and to lie in side-by-side relation to the body of the retainer lug.

22. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures and a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, wherein the quick-mount support further includes a slide support bracket including a slide mount portion coupled to the stationary slide and a rack mount portion arranged to lie at an angle to the slide mount portion, a forwardly facing surface of the rack mount portion is arranged to lie in mating relation to a rearwardly facing surface of the vertical rack to place a retainer aperture formed in the rack mount portion in alignment with the second of the retainer apertures formed in the vertical rack to form a retainer passageway containing a portion of the movable retainer as the movable retainer moves between the raised and locked position and the lowered and unlocked position, the slide support bracket further including a locator arm coupled to the rack mount portion and arranged to extend away from the forwardly facing surface of the rack mount portion into the second of the retainer apertures formed in the vertical rack and to lie in side-by-side relation to the movable retainer.

23. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures and a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, wherein the quick-mount support further includes a slide support bracket including a slide mount portion coupled to the stationary slide and a rack mount portion arranged to lie at an angle to the slide mount portion, a forwardly facing surface of the rack mount portion is arranged to lie in mating relation to a rearwardly facing surface of the vertical rack to place a retainer aperture formed in the rack mount portion in alignment with the second of the retainer apertures formed in the vertical rack to form a retainer passageway containing a portion of the movable retainer as the movable retainer moves between the raised and locked position and the lowered and unlocked position, the slide support bracket further including a pair of locator arms arranged to lie in spaced-apart relation to one another to receive the movable retainer therebetween and each of the locator arms is coupled to the rack mount portion and arranged to extend away from the forwardly facing surface of the rack mount portion into the second of the retainer apertures formed in the vertical rack and to lie in side-by-side relation to the movable retainer.

24. A telescoping slide assembly support system comprising a telescoping slide assembly including load-carrying and stationary slides movable relative to one another to extend and retract the load-carrying slide relative to the stationary slide between fully extended and retracted positions, a vertical rack formed to include a series of retainer apertures, and a quick-mount support coupled to the stationary slide, the quick-mount support includes a fixed retainer arranged to extend through a first of the retainer apertures and a movable retainer arranged to extend through a second of the retainer apertures and mounted for pivotable movement about a retainer pivot axis through an acute angle between a lowered and unlocked position arranged to lie in the second of the retainer apertures at a first distance from the fixed retainer and a raised and locked position arranged to lie in the second of the retainer apertures at a greater, second distance from the fixed retainer, wherein the movable retainer includes a retainer lug configured to extend through the second of the retainer apertures when the movable retainer is located in the lowered and unlocked position and to mate with a forwardly facing surface on the vertical rack when the movable retainer is located in the raised and locked position and the quick-mount support further includes mover means for moving the movable retainer to the lowered and unlocked position to permit movement of the retainer lug into and out of the second of the retainer apertures during coupling and uncoupling of the quick-mount support and the vertical rack and to the raised and locked position to mate the retainer lug and the vertical rack to block uncoupling of the quick-mount support and the vertical rack, the quick-mount support further including a slide support bracket coupled to the stationary slide and arranged to lie in mating relation to the vertical rack to position retainer apertures formed in the slide support bracket in alignment with retainer apertures formed in the vertical rack, the movable retainer is mounted to the slide support bracket for pivotable movement about a retainer pivot axis, and the mover means includes a pivotable actuator provided with a finger grip and mounted to the slide support bracket for pivotable movement about an actuator pivot axis and a driver pivotably coupled to the pivotable actuator and movable retainer to cause the movable retainer to move in clockwise direction about the retainer pivot axis in response to counterclockwise movement of the pivotable actuator about the actuator pivot axis.

25. The system of claim 24, wherein the movable retainer further includes a base arranged to intercept the retainer pivot axis and a mid-section interconnecting the retainer lug and the base and the driver is pivotably coupled to the mid-section of the movable retainer.

* * * * *